US007080950B1

(12) United States Patent
Lin

(10) Patent No.: US 7,080,950 B1
(45) Date of Patent: Jul. 25, 2006

(54) PENCIL WITH BUFFERING EFFECT FOR PREVENTING A PENCIL LEAD FROM BREAKING

(76) Inventor: Chia-Hsiung Lin, 235 P.O. Box 10-69, Chung-Ho, Taipei (TW)

( * ) Notice: Subject to any disclaimer, the term of this patent is extended or adjusted under 35 U.S.C. 154(b) by 0 days.

(21) Appl. No.: 11/262,450

(22) Filed: Oct. 31, 2005

(51) Int. Cl.
*B43K 21/02* (2006.01)

(52) U.S. Cl. ..... 401/54; 401/65; 401/67

(58) Field of Classification Search ..... 401/54, 401/58, 65, 67, 103, 109, 115
See application file for complete search history.

(56) References Cited

U.S. PATENT DOCUMENTS 4,171,170 A * 10/1979 Kageyama et al. ..... 401/54
4,343,558 A * 8/1982 Fujiwara ..... 401/67
5,149,219 A * 9/1992 Kageyama et al. ..... 401/65

* cited by examiner

*Primary Examiner*—Tuan Nguyen

(57) ABSTRACT

A pencil with buffering effect for prevent a pencil lead from breaking comprises a head tube; a stepped element installed within the head tube and resisting against a front end of the spring; a spring; the spring having two sections, a front section and a rear section; the front section being denser than the rear section; a positioning tube; a plug resisting against the positioning tube; an inner tube enclosed by the spring and a rear end of the spring being in contact with the positioning tube; the inner tube passing through the positioning tube; a distal end of the inner tube being connected to a plug; a sleeve enclosing the inner tube and the positioning tube; the sleeve being connected to the head tube; and a pencil lead received within the stepped element.

2 Claims, 5 Drawing Sheets

PENCIL WITH BUFFERING EFFECT FOR PREVENTING A PENCIL LEAD FROM BREAKING

FIELD OF THE INVENTION

The present invention relates to pencils, and in particular to a pencil with buffering effect for prevent a pencil lead from breaking, wherein a spring is installed in an inner tube of the pencil and is positioned between a head tube and a positioning tube. A front section of the spring is denser than the rear section thereof. When the pencil lead is compressed, a stepped element will resist against the spring to provide a buffer force to the pencil lead. Thereby the pencil lead is prevented from break.

BACKGROUND OF THE INVENTION

In the prior art auto-control pencil, the pencil lead is driven in a transfer tube and a movable claw element. However the pencil lead is easy to break as a great force is applied therein. The spring in the transfer tube only has the function of pushing the pencil lead instead of preventing the pencil lead from breaking. If the force applied therein is too great, the pencil lead will be compressed to break, specifically it is easily occurred as the pencil is operated by children because the children cannot apply a proper force to the pencil.

SUMMARY OF THE INVENTION

Accordingly, the primary object of the present invention is to provide a pencil with buffering effect for prevent a pencil lead from breaking, wherein the pencil provides an elastic buffer force to the pencil lead so as to disperse the pressure to the pencil lead. Thereby the pencil lead is avoided to break. Thus the writing operation can be performed conveniently. Thereby children can operate the pencil easily.

To achieve above objects, the present invention provides a pencil with buffering effect for prevent a pencil lead from breaking. The pencil comprises a head tube; a stepped element installed within the head tube and resisting against a front end of the spring; a spring; the spring having two sections, a front section and a rear section; the front section being denser than the rear section; a positioning tube; a plug resisting against the positioning tube; an inner tube enclosed by the spring and a rear end of the spring being in contact with the positioning tube; the inner tube passing through the positioning tube; a distal end of the inner tube being connected to a plug; a sleeve enclosing the inner tube and the positioning tube; the sleeve being connected to the head tube; and a pencil lead received within the stepped element. When the user holds the auto-control pencil for writing, the pencil lead at the front end will make the stepped element moving backwards to compress the spring to have a buffer force to buffer the pressure applied to the pencil lead; thereby the pencil lead is avoided to break. The spring is made of metal.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
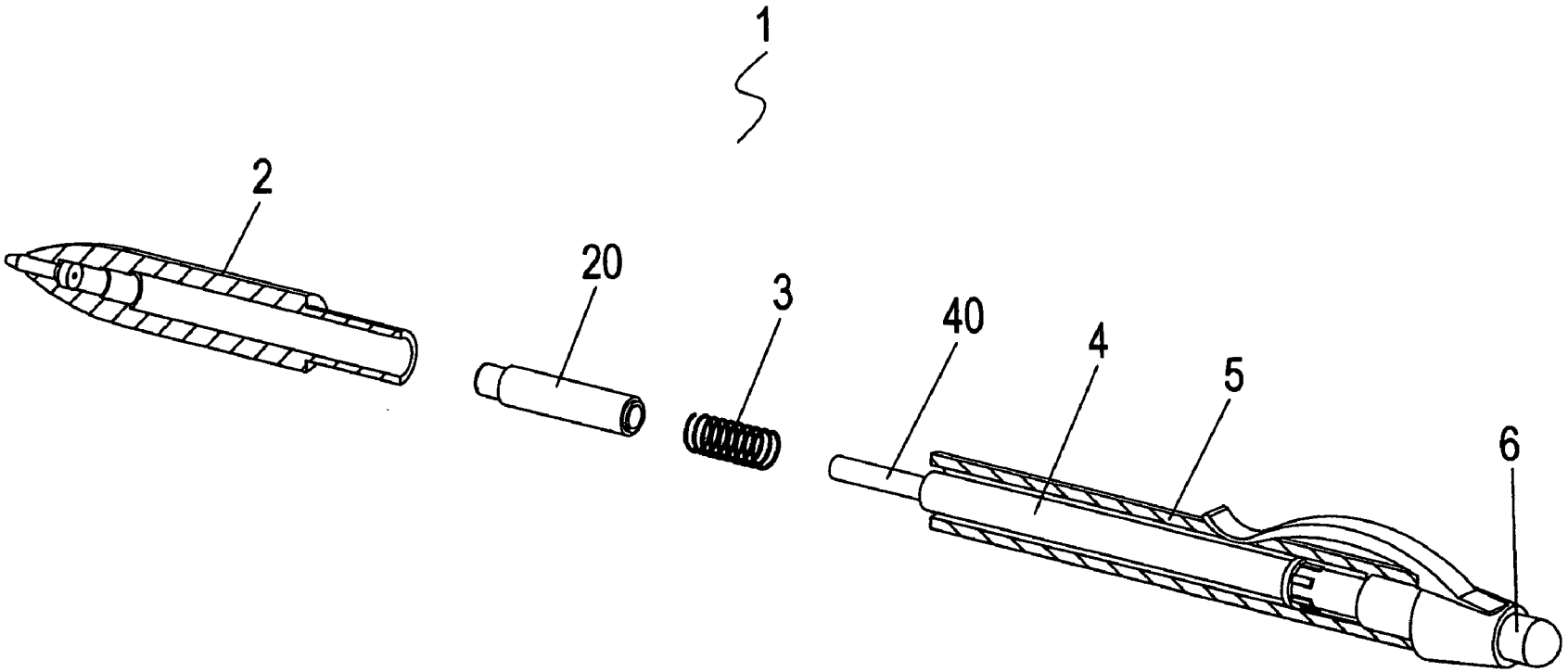
FIG. 1 is an exploded perspective view of the present invention.
Figure 2:
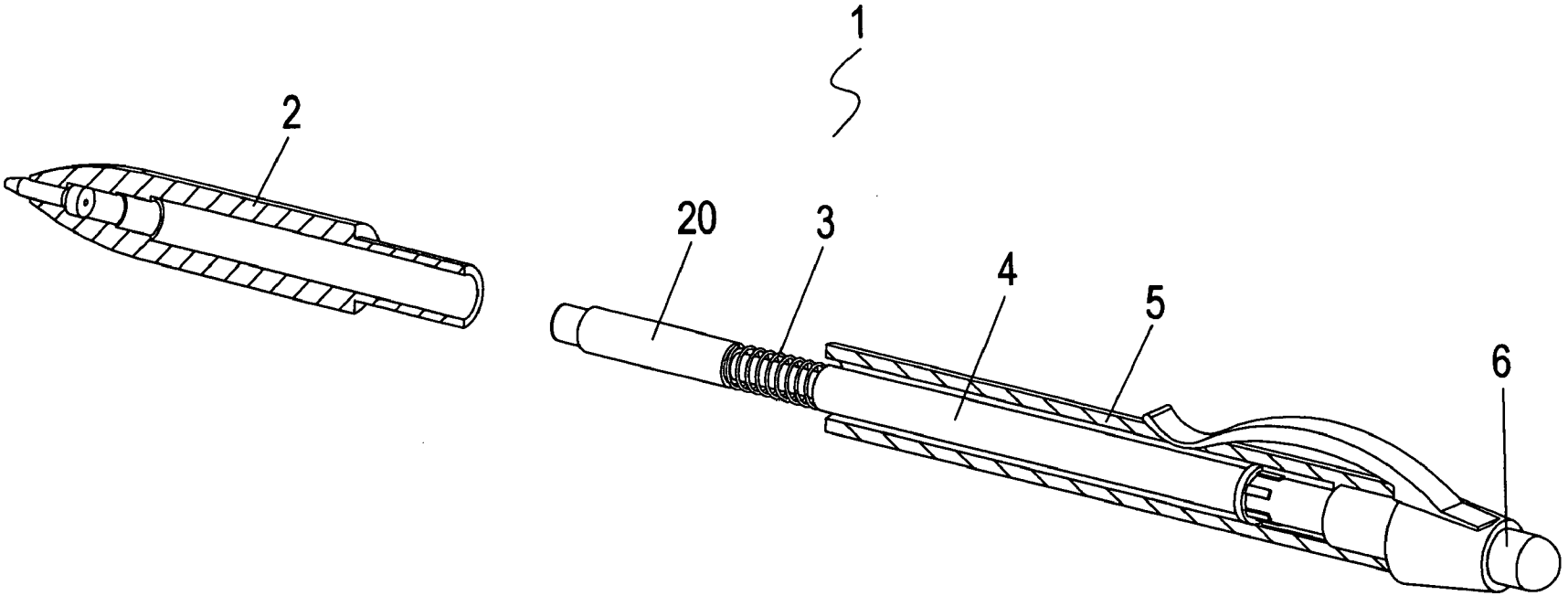
FIG. 2 is an assembled perspective view of the spring of the present invention.
Figure 3:
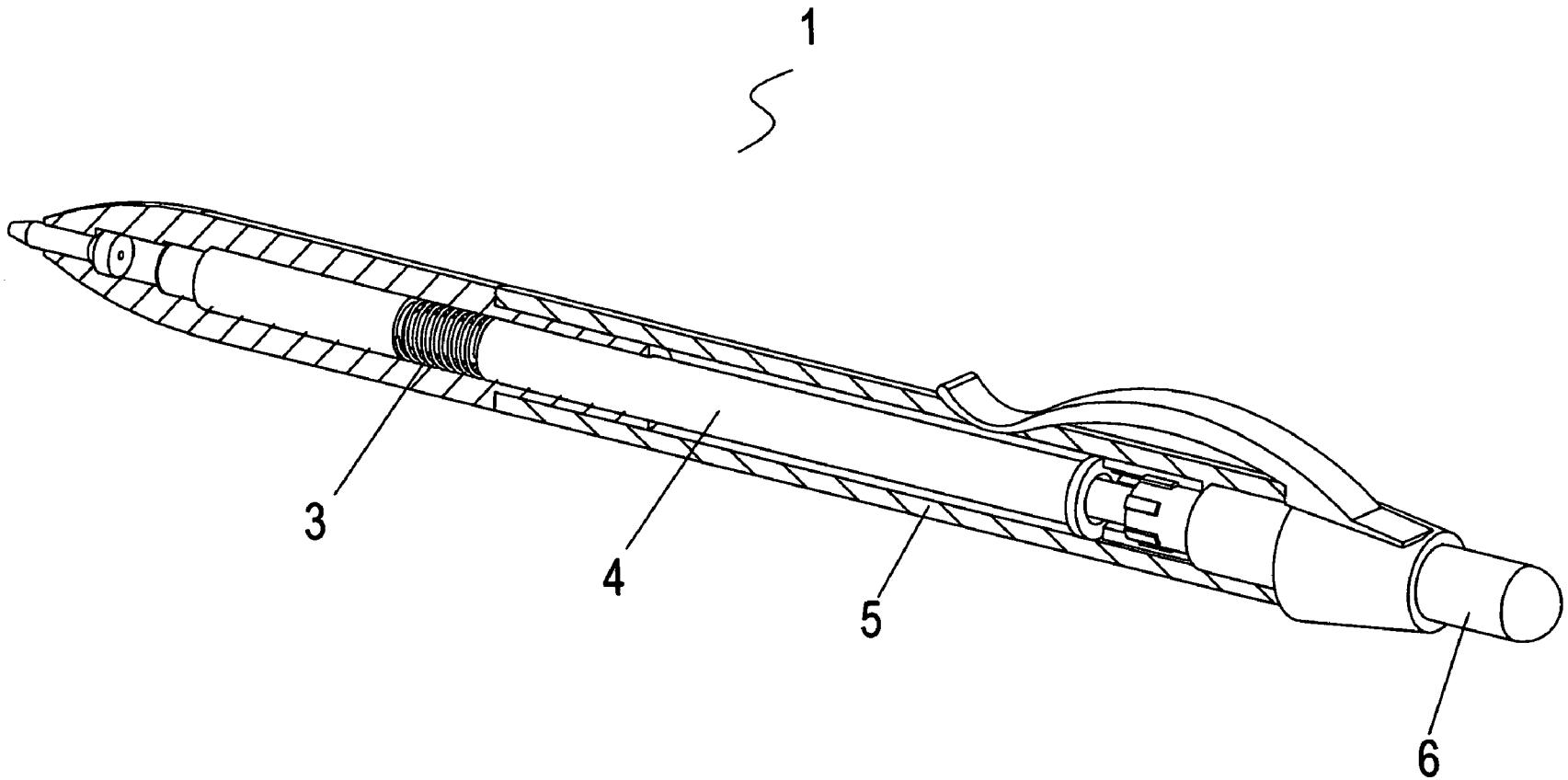
FIG. 3 is an assembled perspective view of the present invention.
Figure 4:
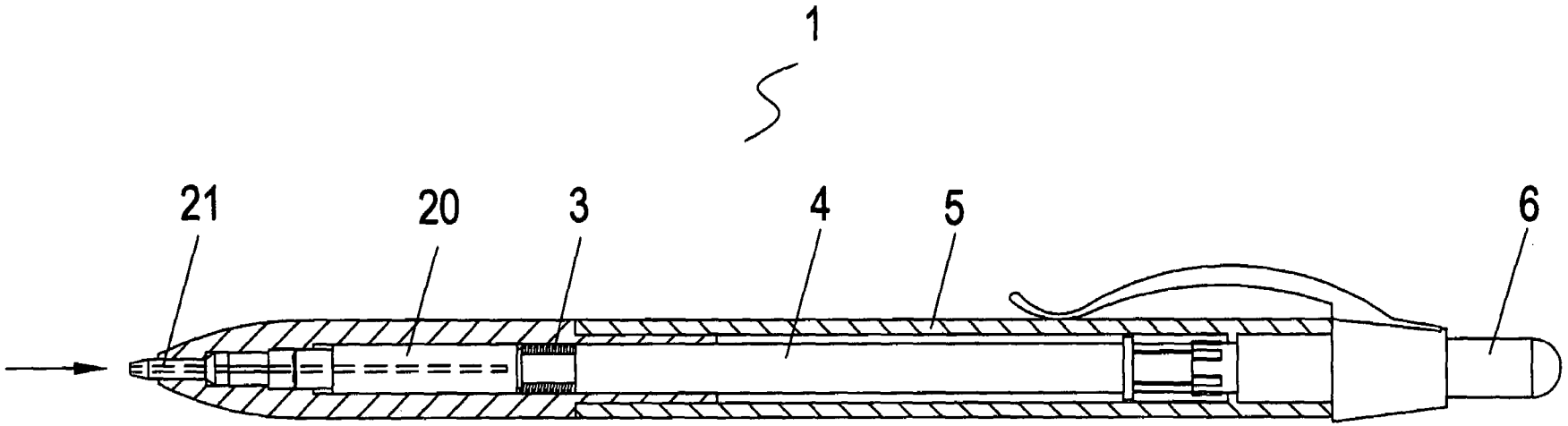
FIG. 4 is a cross sectional view about one embodiment of the present invention before compression.
Figure 5:
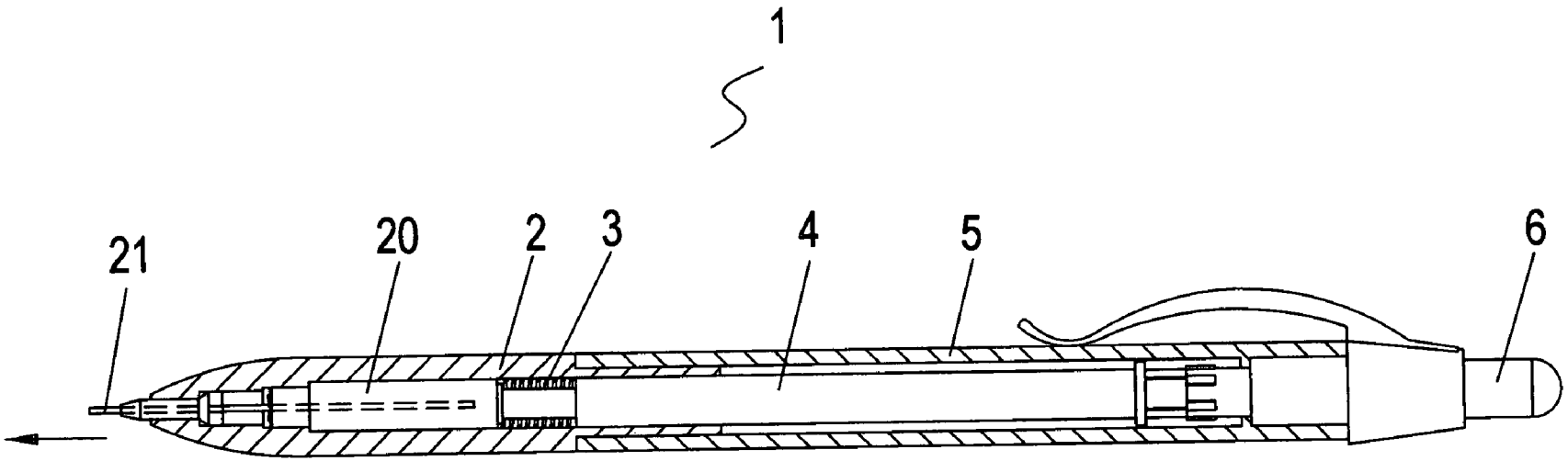
FIG. 5 is a cross sectional view about one embodiment of the present invention after compression.

Referring to FIGS. 1 to 5, the auto-control pencil 1 of the present invention has the following elements.

A head tube 2 is included.

A stepped element 20 is installed within the head tube 2 and resists against a front end of the spring 3.

A spring 3 has made of metal. For example, the spring 3 may have two sections, a front section and a rear section. The front section is denser than the rear section.

A positioning tube 4 is included. The spring 3 and positioning tube 4 are placed into to a rear end of the auto-control pencil 1. The plug 6 resists against the positioning tube 4.

An inner tube 40 is enclosed by the spring 3 and a rear end of the spring 3 is in contact with the positioning tube 4. The inner tube 40 passes through the positioning tube 4. A distal end of the inner tube 40 is connected to a plug 6.

A sleeve 5 sleeves the inner tube 40 and the positioning tube 4. The sleeve 5 is connected to the head tube 2.

A pencil lead 21 is received within the stepped element 20.

When the user holds the auto-control pencil 1 for writing, the pencil lead 21 at the front end will make the stepped element 20 moving backwards to compress the spring 3 to have a buffer force to buffer the pressure applied to the pencil lead 21. Thereby the pencil lead 21 is avoided to break. Thereby the writing operation can be performed conveniently.

Advantages of the present invention will be described herein. The present invention provides an elastic buffer force to the pencil lead so as to disperse the pressure to the pencil lead. Thereby the pencil lead is avoided to break. Thereby the writing operation can be performed conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pencil with buffering effect for preventing a pencil lead from breaking; the pencil comprising:

a head tube;

a stepped element installed within the head tube and resisting against a front end of the spring;

a spring; the spring having two sections, a front section and a rear section; the front section being denser than the rear section;

a positioning tube;

a plug resisting against the positioning tube;

an inner tube enclosed by the spring and a rear end of the spring being in contact with the positioning tube; the inner tube passing through the positioning tube; a distal end of the inner tube being connected to a plug;

a sleeve enclosing the inner tube and the positioning tube; the sleeve being connected to the head tube; and a pencil lead received within the stepped element; and wherein when the user holds the auto-control pencil for writing, the pencil lead at the front end will make the stepped element moving backwards to compress the spring to have a buffer force to buffer the pressure applied to the pencil lead; thereby the pencil lead is avoided to break.

2. The pencil with buffering effect for preventing a pencil lead from breaking as claimed in claim 1, wherein the spring is made of metal.

* * * * *